US010428556B2

(12) United States Patent
Bowley et al.

(10) Patent No.: US 10,428,556 B2
(45) Date of Patent: Oct. 1, 2019

(54) HIGH SECURITY LOCKING SYSTEM WHICH FORMS A DEVIATING PICKING PATH AND ASSOCIATED DEVIATED KEY

(71) Applicant: Bowley Lock Company Inc., Calgary (CA)

(72) Inventors: Ryan Thomas Bowley, Calgary (CA); Tyler George Bowley, Calgary (CA)

(73) Assignee: Bowley Lock Company Inc., Calgary (CA)

( * ) Notice: Subject to any disclaimer, the term of this patent is extended or adjusted under 35 U.S.C. 154(b) by 23 days.

(21) Appl. No.: 15/539,736

(22) PCT Filed: Sep. 25, 2015

(86) PCT No.: PCT/CA2015/050965
§ 371 (c)(1),
(2) Date: Jun. 26, 2017

(87) PCT Pub. No.: WO2016/112454
PCT Pub. Date: Jul. 21, 2016

(65) Prior Publication Data

US 2017/0350162 A1 Dec. 7, 2017

Related U.S. Application Data

(60) Provisional application No. 62/102,870, filed on Jan. 13, 2015.

(51) Int. Cl.

| | |
|---|---|
| ***E05B 27/00*** | (2006.01) |
| ***E05B 19/14*** | (2006.01) |
| ***E05B 19/00*** | (2006.01) |

(52) U.S. Cl.
CPC ..... *E05B 27/001* (2013.01); *E05B 19/0017* (2013.01); *E05B 19/0041* (2013.01);
(Continued)

(58) Field of Classification Search
CPC .. E05B 19/0017; E05B 19/0041; E05B 19/14; E05B 27/001; E05B 27/0017;
(Continued)

(56) References Cited

U.S. PATENT DOCUMENTS 215,649 A * 5/1879 Merriam ..... E05B 29/00 70/492
321,306 A * 6/1885 Markham ..... E05B 29/00 70/419

(Continued)

FOREIGN PATENT DOCUMENTS

CN 101699005 4/2010
CN 103850535 6/2014

*Primary Examiner* — Christopher J Boswell
(74) *Attorney, Agent, or Firm* — Ryan W. Dupuis; Ade + Company Inc.; Kyle R. Satterthwaite

(57) ABSTRACT

A high security locking system comprising a deviated key and a lock housing. The lock housing may further comprise a face plate with a keyhole for receiving the deviated key and first pin slots disposed within the lock housing. The high security locking system may comprise a lock cylinder disposed within the lock housing and include second pin slots disposed within the lock cylinder. An idler block may be disposed within the lock cylinder and may be rotatable, which may allow the deviated key to align with one or more of the second pin slots in the lock cylinder. Additionally, a stationary block may be disposed within the lock cylinder and the deviated key may rotate around the lock without interfering with the stationary block.

20 Claims, 14 Drawing Sheets

(52) U.S. Cl.
CPC ..... *E05B 19/14* (2013.01); *E05B 27/006* (2013.01); *E05B 27/0007* (2013.01); *E05B 27/0017* (2013.01); *E05B 27/0057* (2013.01)

(58) Field of Classification Search
CPC ..... E05B 27/0057; E05B 27/006; E05B 27/0007; E05B 29/00
See application file for complete search history.

(56) References Cited

U.S. PATENT DOCUMENTS 2,552,012 A * 5/1951 O'Kane ..... E05B 19/00 70/419
2,682,764 A * 7/1954 Kotab ..... E05B 19/00 70/392
4,094,175 A 6/1978 Pechner
4,104,898 A * 8/1978 Fois ..... E05B 17/185 70/419
4,732,023 A 3/1988 Shen
4,787,225 A * 11/1988 Hauser ..... E05B 19/0017 70/401
6,079,239 A * 6/2000 Hsiao ..... E05B 29/00 70/358
6,698,264 B1 * 3/2004 Liao ..... E05B 27/001 70/375
6,758,073 B2 * 7/2004 Yu ..... E05B 27/001 70/358
7,174,757 B1 * 2/2007 Tseng ..... E05B 15/08 70/358
7,240,526 B2 * 7/2007 Lee ..... E05B 17/14 703/358
8,739,583 B2 6/2014 Avganim
9,435,140 B2 * 9/2016 Chen ..... E05B 27/0057

* cited by examiner

HIGH SECURITY LOCKING SYSTEM WHICH FORMS A DEVIATING PICKING PATH AND ASSOCIATED DEVIATED KEY

CROSS-REFERENCE TO RELATED APPLICATIONS

The present application claims priority to U.S. Provisional Application No. 62/102,870, filed on Jan. 13, 2015, the entire disclosure of which is incorporated herein by reference.

BACKGROUND

Embodiments relate generally to security locks and deviated keys for the purpose of controlling entry to doorways, padlocks, safes, automobiles and the like. More particularly, embodiments may relate to anti pick or pick proof high security locking systems.

Currently, general security locks and keys may be susceptible to tampering and may easily be overcome. This may lead to unauthorized access to potentially sensitive areas secured by locks and keys. High security locking systems may be used to properly restrict access to controlled areas. Generally, high security or pick proof locks may include a common shaped linear key in which many surfaces of the key have features or biting which interact with tumbler pins that are on several different axes. These features often may be nonstandard shapes to make key copying difficult. Additionally, the tumbler pins or tumblers themselves may have special shapes similar to a bobbin which should make them hard to "set" or create a false set during picking efforts. This combination of features makes picking the lock difficult through making the effort much more tedious by increasing the number and complexity of the tumbler pin arrangement. However, current high security locking systems have drawbacks. For example, the manipulation of the tumbler pins and tumblers is readily accessible from the inlet of the linear key hole and often can be picked using straight picking tools.

SUMMARY

These and other needs in the art are addressed in an embodiment by a high security locking system comprising a deviated key, a lock housing, a lock cylinder, an idler block, and a stationary block. The lock housing may comprise a face plate with a keyhole for receiving the deviated key and includes first pin slots formed in the lock housing. The lock cylinder may be disposed within the lock housing and may include second pin slots formed in the lock cylinder. The idler block may be disposed within the lock cylinder and may be rotatable. The deviated key may rotate the idler block and align with one or more of the second pin slots in the lock cylinder. The stationary block may be disposed within the lock cylinder and the deviated key may rotate around the lock without interference with the stationary block.

A method of operating a high security locking system may comprise inserting a deviated key into a lock housing where an idler block may be disposed in the lock housing and block access to tumbler pins of the high security locking system. The tumbler pins may be positioned to prevent relative rotation between a lock cylinder and the lock housing as the lock cylinder may be disposed in the lock housing. Rotating the deviated key within the lock housing allows the deviated key to rotate the idler block with respect to the lock cylinder.

Aligning the deviated key with one or more first pin slots in the lock housing and one or more second pin slots in the lock cylinder. The tumbler pins may be disposed in the pin slots and/or the second pin slots. Moving the deviated key translationally in the notch housing which may causes at least one of the tumbler pins to move and enable relative rotation between the locking cylinder and the lock housing.

In additional embodiments a lock system may comprise a lock housing with first pin slots, which may be disposed in the lock housing. Additionally the lock system may comprise a rotation housing, which may comprise second pin slots disposed in the rotation housing. One or more of the second pin slots may be at different depths in the rotation housing. Each of the second pin slots may align with a respective one of the first pin slots.

In further embodiments, a lock system may comprise a lock housing where first pin slots may be disposed in the lock housing. The lock system may comprise a rotation housing where second pin slots may be disposed in the rotation housing and each of the second pin slots may align with a respective one of the first pin slots. Tumbler pins may be at least partially received within the second pin slots in the rotation housing and a long pin may be at least partially received within one of the second pin slots. The long pin may be at its lowest position and not block a shear plain between the rotation housing and the lock cylinder.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

These drawings illustrate certain aspects of some of the embodiments of the present invention and should not be used to limit or define the invention.

DETAILED DESCRIPTION

Figure 1:
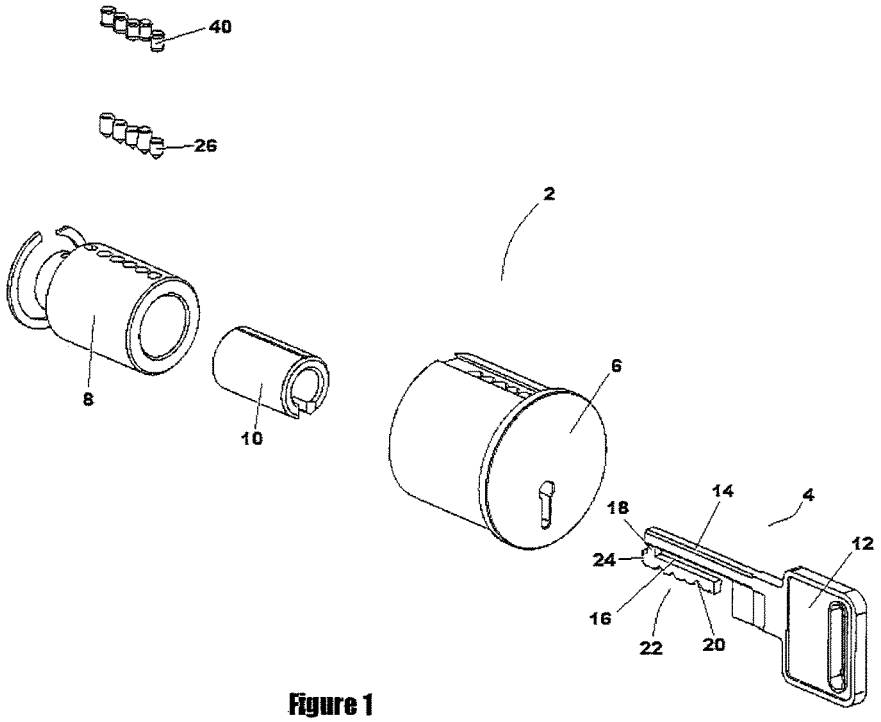
FIG. 1 illustrates an exploded view of a high security locking system.

The disclosed embodiments recite a high security locking system, where the lock and deviated key may form a deviated path. Advantageously, the deviated path may restrict the ability of any tampering equipment from entering the high security locking system by creating a deviated pick path in order to access the tumbler pins. This may be accomplished by using rotating idler block and/or a plurality of rotating idler blocks that when rotated relative to a stationary block and/or blocks break the initial entry slot of the keyhole into a deviated path of changing direction. This deviated path may restrict access to the tumbler pins from outside of the high security locking system unless rotated with the idler block.

Generally, a deviated key may be inserted into the high security locking system but may not engage the locking assembly. As used herein, the term "deviated key" refers to a deviated key having a shaft defining a deviated key axis of rotation and a pin engagement portion which is radially offset from the deviated key axis of rotation and/or separated from the shaft by an axial slot. The deviated key may comprise a number of different shapes, including, but not limited to, an axial fork shaped deviated key, reverse axial fork shaped deviated key, radial forked shaped deviated key, and/or any combinations thereof. In embodiments, the deviated key may be able to freely rotate within the high security locking system. The high security locking system may contain an idler block which may rotate with the deviated key. This rotation of the deviated key within an idler block may produce a path for the deviated key to access a set of tumbler pins. In general, the tumbler pins may be located at angle away from the initial deviated key entry angle. This may require the idler block inside to be turned by the deviated key to expose the tumbler pins to the deviated key. The idler block may hold the tumbler pins in a locked position and may further physically cover the tumbler pins, preventing access to the tumbler pins. Upon rotation within the high security locking system, the deviated key may be trapped within the high security locking system. Rotation of the deviated key back in line with the initial entry angle may allow for the deviated key to be removed. Once the deviated key is in position of the tumbler pins, the tumbler pins may interact with the deviated key to free a lock cylinder, which may be rotated to open or close the lock. In embodiments, the deviated key may be pushed further in or out, engaging the lock cylinder which may provide torque to operate the high security locking system.

Generally, an attempt to pick the high security locking system may require special shaped tools. These tools may have difficulty accessing the tumbler pins due to the stationary block. The amount of tools that may be necessary to successfully pick the high security locking system may prevent each tool from functioning properly. Additionally, general locks may be broken into by drilling out the cylinder, rendering the locking mechanism useless. In embodiments, the high security locking system may comprise a face and a lock housing which may include hardened objects, preventing the ability to drill out the high security locking system. For example, small cylinders of tungsten carbide, hardened steel, diamond inserts, and/or the like may be pressed into multiple locations to render any machine tool useless.

FIG. 1 illustrates an embodiment of a high security locking system 2. High security locking system 2 may comprise a deviated key 4, lock housing 6, lock cylinder 8, and idler block 10. In embodiments, high security locking system 2 may comprise any suitable material to withstand wear and tear. Suitable material may be, but is not limited to metal alloys, stainless steel, aluminum, brass, tungsten carbide, and/or any combination thereof. The deviated key 4 may be inserted into a keyhole 30 in lock housing 6. The lock cylinder 8 and the idler block 10 may be disposed in the lock housing 6. The idler block 10 may rotate with the deviated key 4 to expose the tumbler pins 26 to the deviated key 4. In the illustrated embodiment, the lock cylinder 8 may be stationary with respect to this rotation of the idler block 10. In embodiments, the lock cylinder 8 may rotate once the tumbler pins 26 have engaged the deviated key 4.

In embodiments, deviated key 4 may be machined and/or formed to unlock and lock high security locking system 2. Deviated key 4 may comprise a handle 12, a shaft 14, and/or an offset arm 16. Handle 12 may comprising any suitable shape. A suitable shape may be, but is not limited to circular, triangular, square, polyhedral, and/or any combination thereof. Handle 12 may act as a support for shaft 14 and offset arm 16. Additionally, handle 12 may form a contact area upon which a user may grip deviated key 4, allowing a user to insert deviated key 4 within high security locking system 2. A user may use base 12 to rotate deviated key 4 within high security locking system 2 and further adjust deviated key 4 in any axial direction while within high security locking system 2.

As illustrated in FIG. 1, shaft 14 may attach to handle 12 and extend away from base 12, in any direction. Shaft 14 may comprise any suitable shape. A suitable shape may be, but is not limited to, circular, triangular, square, polyhedral, and/or any combination thereof. In embodiments, shaft 14 may be formed and/or machined with handle 12. Shaft 14 may extend longitudinally from any location along an edge of handle 12, which may define an axis of rotation of deviated key 4. The axis of rotation of deviated key 4 may be defined as the area between handle 12 and the end of shaft 14 opposite handle 12. The axis of rotation of the deviated key 4 may be defined by the shaft 14. At least one offset arm 16 may extend from shaft 14. In embodiments, there may be a plurality of offset arms which may attach to shaft 14.

Offset arm 16, as illustrated in FIG. 1, may attach to shaft 14 by extension 18. Extension 18 may be any suitable shape. A suitable shape may be, but is not limited to, circular, triangular, square, polyhedral, and/or any combination thereof. Additionally, extension 18 may be any suitable length, which may allow offset arm 16 to function properly within high security locking system 2. Extension 18 may be formed and/or machined with shaft 14. In embodiments, extension 18 may attach to shaft 14 at any suitable location along shaft 14 and may attach to offset arm 16 at any suitable location along offset arm 16. In embodiments extension 18 may attach about an edge of shaft 14 further away from handle 12, may attach about an edge of shaft 14 near the attachment area of shaft 14 and handle 12, and/or may attach between the edge of shaft 14 opposite handle 12 and the edge of shaft 14 near the attachment area of shaft 14 and handle 12. Additionally extension 18 may attach to offset arm 16 about one edge, about the opposing edge, or between both edges. Offset arm 16 may form the structure of deviated key 4 which may be used to manipulate tumbler pins 26 and upper pins 40 to unlock high security locking system 2.

As illustrated in FIG. 1, offset arm 16 may further comprise at least one pin engagement 20, a base plane 22, and a protuberance 24. In embodiments, there may be a plurality of offset arms 16 disposed about deviated key 4. Offset arm 16 may be any suitable shape. A suitable shape may be, but is not limited to, circular, triangular, square, polyhedral, and/or any combination thereof. In embodiments, a pin engagement 20 may take a shape identical to tumbler pins 26. This shape may be cut, manufactured, and/or formed into offset arm 16. Additionally, pin engagements 20 may be cut at an angle at least along one edge of pin engagements 20. The angled cut may help dispose tumbler pins 26 on a base plane 22. For example, when pins 26 are disposed within pin engagements 20, axially moving deviated key 4 may slide the angled cut into tumbler pins 26. Tumbler pins 26 may slide along the angled cut, which may lift tumbler pins 26 and dispose them upon base plane 22. In relation to pin engagements 20, the angled cut of pin engagements 20 may be about ten degrees to about sixty degrees, about twenty degrees to about fifty degrees, or about thirty degrees to about forty-five degrees. Specifically, about thirty degrees, about sixty degrees, or about forty-five degrees. In embodiments there may be at least one pin engagement 20. Pin engagements 20 may be located adjacent to each other, along an edge of offset arm 16. As discussed below, tumbler pins 26 may be disposed in pin engagements 20 when attempting to unlock high security locking system 2. Before being disposed within pin engagements 20, tumbler pins 26 may be disposed on base plane 22.

Figure 4:
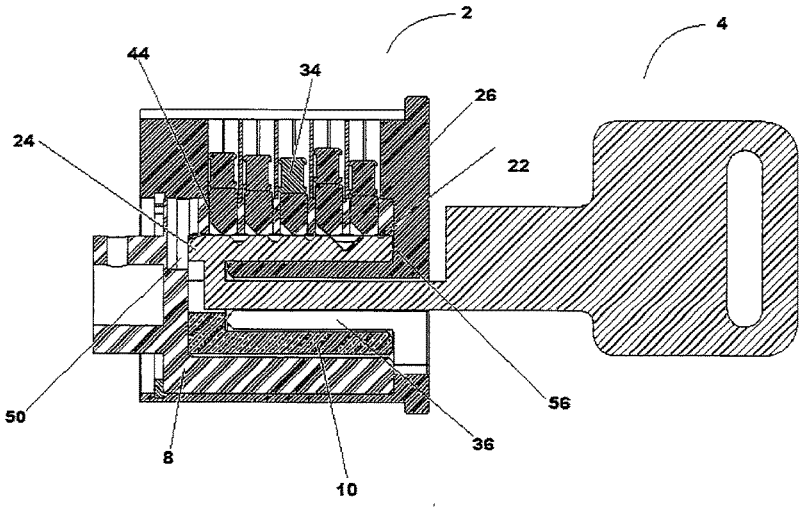
FIG. 4 illustrates the deviated key rotated in the high security locking system of FIG. 1.

Base plane 22 may be a plane upon which tumbler pins 26 rest before engaging pin engagements 20. As illustrated in FIGS. 1 and 4, base plane 22 may comprise a single level plane that may run the length of offset arm 16. Base plane 22 may also be disposed on the edge of offset arm 16 furthest from shaft 14. In embodiments, pin engagements 20 and base plane 22 may be disposed on the same edge of offset arm 16. Further, pin engagements 20 may be disposed below base plane 22. In embodiments, base plane 22 may form an edge of protuberance 24.

Protuberance 24 may be a designated area of offset arm 16 that extends in the direction opposite pin engagements 20. Protuberance 24 may not comprise any pin engagements 20. In embodiments, protuberance 24 may be located at either end of offset arm 16. Protuberance 24 may be any suitable shape. A suitable shape may be, but is not limited to, circular, triangular, square, polyhedral, and/or any combination thereof. In embodiments, protuberance 24 may extend from either end of offset arm 16 any suitable length in which to unlock and lock high security locking system 2. As discussed below, protuberance 24 may be disposed within notch housing 50, which may allow deviated key 4 to rotate lock cylinder 8 within lock housing 6.

Figure 2:
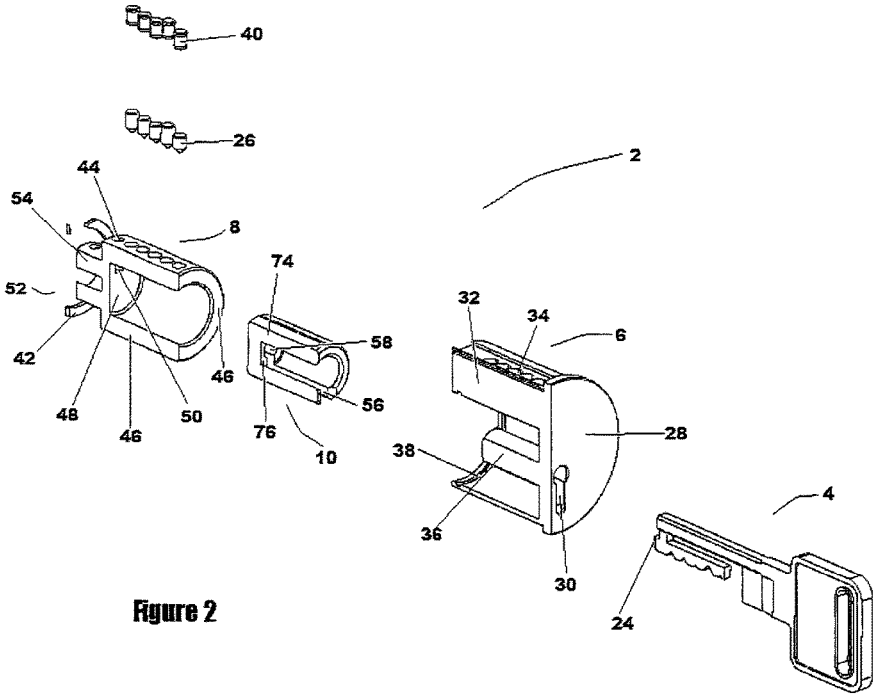
FIG. 2 illustrates a cutaway of the high security locking system of FIG. 1.

With reference now to FIG. 2, lock housing 6 will now be described in more detail in accordance with particular embodiments. As illustrated in FIG. 2, lock housing 6 may form an outer protective housing for high security locking system 2. In embodiments, locking housing 6 may form any suitable shape. A suitable shape may be, but is not limited to cylindrical, spherical, cubical, an octagonal prism, and/or any combination thereof. In embodiments, lock housing 6 may be disposed within any structure which may be used to prevent movement between one area and another. Lock housing 6 may be located on the structure in any suitable location to allow a user to unlock or lock the structure. Lock housing 6 may comprise a face plate 28, a keyhole 30, an outside wall 32, pin slots 34, a stationary block 36, and a groove 38. Face plate 28 may have any suitable shape. A suitable shape may be, but is not limited to circular, triangular, square, polyhedral, and/or any combination thereof. In embodiments, face plate 28 may be used to protect lock housing 6 from tampering and may hold high security locking system 2 in place within a structure. To prevent tampering and/or the drilling of face plate 28 and lock housing 6, hardened objects may be included in the material make up of face plate 28. This may prevent the ability of one to drill out high security locking system 2. For example, small cylinders of tungsten carbide may be pressed into multiple locations of the face plate 28, which may render any machine tool useless which drilling into face plate 28. The hardened objects may comprise any suitable material for reinforcing the face plate, tungsten carbonate, hardened steel, diamond inserts, and/or the like. A keyhole 30 may be disposed within face plate 28, which may allow for deviated key 4 to be inserted within high security locking system 2.

Keyhole 30 may take the shape and dimensions of deviated key 4, as illustrated in FIG. 2. In embodiments, keyhole 30 may be disposed between center of face plate 28 and the lower edge of face plate 28. The location of keyhole 30 may allow for the rotation of deviated key 4 within lock housing 6. However, keyhole 30 may remain stationary as the deviated key 4 is rotated. In embodiments, a stationary block 36 may attach to side of face plate 28 within lock housing 6 and may be disposed adjacent keyhole 30. In embodiments stationary block 36 may attach to lock cylinder 8.

As illustrated in FIG. 2, covered deviated key way 36 may extend within lock housing 6 from face plate 28 about the length of shaft 14. In embodiments, extension 18 of deviated key 4 may extend past stationary block 36 when inserted into high security locking system 2. Stationary block 36 may take the shape and form of keyhole 30, which may prevent anyone from tampering with tumbler pins 26, which may be positioned outside of (e.g., above) covered deviated key way 36. In embodiments, covered deviated key way 36 may receive deviated key 4 in a first angular orientation for axial sliding between a removed position, in which deviated key 4 is external of lock housing 6, and an inserted position, in which deviated key 4 is fully received within lock housing 6. Covered deviated key way 36 may only encircle shaft 14, when deviated key 4 may be in an inserted position. This may allow for offset arm 16 to rotate freely between covered deviated key way 36 and outside wall 32 without corresponding rotation of the keyhole 30.

In the illustrated embodiment, outside wall 32 may form the outermost structure of lock housing 6. In embodiments, outside wall 32 may attach to face plate 28. Face plate 28 may extend past outside wall 32, forming a lip which may be used to hold high security locking system 2 firmly against a structure. As illustrated in FIG. 2, outside wall 32 may comprise a thicker wall at the top than at the bottom of lock housing 6. The thicker area may house pin slots 34. Pin slots 34 may house tumbler pins 26, upper pins 40, and springs (not illustrated). Tumbler pins 26 and upper pins 40 may have a downward force exerted upon them by springs which may push against outer wall 32. As described below, tumbler pins 26 and upper pins 40 may allow for the rotation of lock cylinder 8, which may unlock or lock high security locking system 2. In embodiments, outside wall 32 may not comprise a back wall. This may allow for the insertion of idler block 10 and lock cylinder 8. In embodiments, a groove 38 may be disposed along the edge of outside wall 32 opposite the edge disposed along faceplate 28. Groove 38 may traverse the length of outside wall 32, forming a circle. Lock cylinder 8 may be held in place by retention element 42. As illustrated in FIG. 2, retention element 42 may completely encircle lock cylinder 8. Retention element 42 may allow lock cylinder 8 to rotate within lock housing 6, as retention element 42 may be disposed within groove 38, which may allow lock cylinder 8 to rotate. Retention element 42 may comprise a snap ring, an E-ring, a spiral ring, a self-locking ring, and/or a split ring. Other suitable mechanisms for securing lock cylinder 8 in lock housing 6 may also be used.

With continued reference to FIG. 2, high security locking system 2 may further comprise lock cylinder 8, which may be received in the lock housing 6. As illustrated in FIG. 2, lock cylinder 8 may form a wall opposite face plate 28. Lock cylinder 8 may comprise a tubular sleeve 46 and may freely rotate, with an engaged deviated key 4, within lock housing 6 about a longitudinally extending lock axis. Tubular sleeve 46 may be any thickness in which to support the stress exerted upon lock cylinder 8 from the rotation of deviated key 4 and movement of a locking bolt, not illustrated. Lock cylinder 8 may comprise at least one second pin slot 44, extending radially from lock housing 6 in two axially extending rows at diametrically opposed locations. In embodiments, lock cylinder 8 may be rotatable relative to the lock housing 6 about the lock axis between a locking position in which second pin slots 44 may be aligned with pin slots 34 and an unlocked position in which second pin slots 44 may be angularly offset about the lock axis from pin slots 34.

Additionally, lock cylinder 8 may further comprise a back wall 48, a notch housing 50, and a bolt assembly 52. Back wall 48 may serve as a structure upon which tubular sleeve 46 and bolt assembly 52 may attach. In embodiments, bolt assembly 42 may comprise arms 54, which may attach to the locking bolt (not illustrated). The rotational movement of lock cylinder 8 may move the locking bolt within the structure, effectively unlocking or locking the structure. In embodiments, bolt assembly 52 may be disposed on one side of back wall 48 and tubular sleeve 46 may be disposed on the other side of back wall 48. To rotate lock cylinder 8, a notch housing 50 may be formed and/or machined into back wall 48. Notch housing 50 may be disposed in line with second pin slots 44. This may allow for protuberance 24 on deviated key 4 to be inserted into notch housing 50 by a user as offset arm 16 engages tumbler pins 26. Protuberance 24 may be used to rotate lock cylinder 8 through notch housing 50. In embodiments, lock cylinder 8 may comprise an additional wall, not illustrated, opposite back wall 48, which may further comprise a notch housing 50, in addition to or in place of the notch housing in the back wall 48. This may require a user to move deviated key 4 axially toward the user to dispose protuberance 24 within notch housing 50. In embodiments, notch housing 50 may be concealed by idler block 10. Idler block 10 may be used to prevent tampering with notch housing 50 and tumbler pins 26.

High security locking system 2 may further comprise idler block 10, which may be supported in the lock cylinder 8. As illustrated in FIG. 2, idler block 10 may comprise an idler block tubular sleeve 74, an idler block back wall 76, a channel 56, and a deviated key cutout 58. In embodiments, not illustrated, there may be a plurality of idler blocks 10 which may further prevent tampering with tumbler pins 26. Idler block 10 may be disposed on covered deviated key way 36 and may rotate around covered deviated key way 36. In embodiments, idler block 10 may be inserted into lock housing 6 before lock cylinder 8. Lock cylinder 8 may prevent idler block 10 from being removed from covered deviated key way 36. Idler block 10 may be held in place by lock cylinder 8 and prevent tempering devices from reaching tumbler pins 26 and/or notch housing 50. Disposed between covered deviated key way 36 and lock cylinder 8, idler block 10 may rotate axially during operation. Additionally, best illustrated in FIG. 3, tumbler pins 26 may rest upon idler block 10, which may keep tumbler pins 26 from falling into lock housing 6. Idler block back wall 76 may serve as a structure upon which idler block tubular sleeve 74 may be disposed. In embodiments, a channel 56 may be disposed along one axis of idler block tubular sleeve 74 and may further traverse the length of idler block tubular sleeve 74. Channel 56 may allow for extension 18 and offset arm 16 to access lock housing 6. Additionally, deviated key cutout 58 may allow shaft 14 to pass through idler block 10 and access lock cylinder 8. Accessing lock cylinder 8 with shaft 14 may indicate that deviated key 4 may be fully inserted into high security locking system 2.

Figure 3:
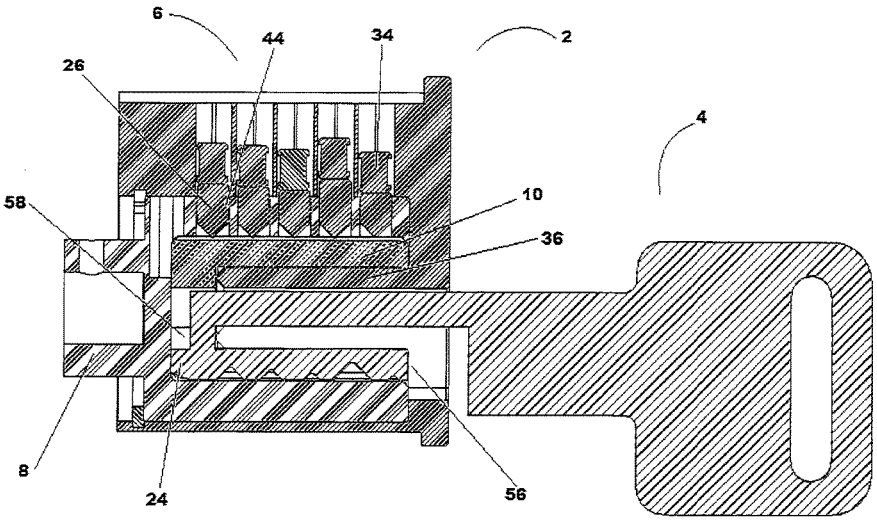
FIG. 3 illustrates a deviated key inserted into the high security locking system of FIG. 1.

Embodiments for operation of high security locking system 2 will now be described in more detail with respect to FIGS. 3-5. Turning now to FIG. 3, embodiments may include insertion of deviated key into high security locking system 2. As illustrated, deviated key 4 may be fully inserted into high security locking system 2. Deviated key 4 (e.g., protuberance 24) may contact back wall 48 of lock cylinder 8. As illustrated, tumbler pins 26 may not interact with the deviated key 4 in this position and there is not a deviated path as the deviated key 4 has not been rotated. Tumbler pins 26 may rest upon idler block 10, which may encircle covered deviated key way 36. Channel 56 and deviated key cutout 58 may allow for offset arm 16, protuberance 24, extension 18, and shaft 14 to access lock housing 6. Tumbler pins 26 may be received within second pin slots 44 so as to be enabled for radial sliding movement relative to lock housing 6. In the locked position, tumbler pins 26 may be partially received within pin slots 34 so as to extend between lock housing 6 and lock cylinder 8, which may prevent rotation of lock cylinder 8. In the un-locked position, tumbler pins 26 may be removed from pin slots 34 and may disposed completely within second pin slots 44, enabling rotation of lock cylinder 8 relative to lock housing 6.

Referring now to FIG. 4, deviated key may be rotated. As illustrated, deviated key 4 may be rotated one hundred and eighty degrees from the original insertion position of deviated key 4. As illustrated, offset arm 16 and protuberance 24 may have rotated above covered deviated key way 36. As deviated key 4 rotates, offset arm and protuberance 24 may rotate idler block 10. Rotation of idler block 10 may be accomplished as force is placed upon channel 56 by offset arm 16 and protuberance 24. Idler block 10 may be rotated with respect to lock cylinder 8 as lock cylinder 8 may remain in the same position. Channel 56 may align with second pin slots 44. The force exerted by springs and upper pins 40 may force tumbler pins 26 to be disposed upon base plane 22. Tumbler pins 26 may still traverse pin slots 34 and second pin slots 44, preventing rotational movement of lock cylinder 8. Additionally, the rotation of idler block 10 may unveil notch housing 50, accessible through channel 56, which may have been covered by back wall 48 of idle block 10. Notch housing 50 may allow a user to protuberance 24, and in turn deviated key 4, into notch housing 50. As illustrated, protuberance 24 may be slide forward into notch housing 50. In embodiments, as mentioned above, notch housing 50 may be located on a separate wall, not illustrated, opposite back wall 48 of lock cylinder 8. The user may then move deviated key 4 away from or back toward the user to insert protuberance 24 into notch housing 50. While FIG. 4 illustrates one hundred and eighty degrees of rotation for access of tumbler pins 26 to deviated key 4, it should be understood that such rotation is not required and high security locking system 2 may be configured so that tumbler pins 26 access deviated key with more, or less than, one hundred and eighty degrees of rotation, for example, ninety degrees, two hundred and seventy degrees, etc.

Figure 5:
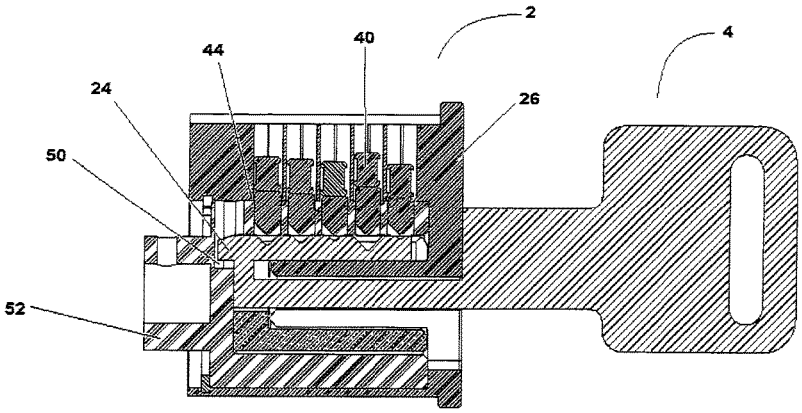
FIG. 5 illustrates the deviated key engaging a set of tumbler pins of FIG. 1.

FIG. 5 illustrates deviated key 4 fully engaged within high security locking system 2. In the illustrated, embodiment, protuberance 24 of deviated key 4 has been moved into notch housing 50. As deviated key 4 slides into notch housing 50, tumbler pins 26 may fall into pin engagements 20. Pin engagements 20 may be deep enough to allow tumbler pins 26 to be disposed completely within second pin slots 44 but not deep enough as to allow upper pins 40 to be disposed within second pin slots 44. With tumbler pins 26 fully disposed in second pin slots 44, a user may rotate deviated key 4, which may rotate lock cylinder 8. Rotation of lock cylinder 8 may be accomplished through protuberance 24, which may exert force upon notch housing 50 and in turn rotate lock cylinder 8 in any clockwise or counter clockwise direction. Rotation of lock cylinder 8 may move a bolt, not illustrated, through bolt assembly 52. Movement of the bolt within a structure may unlock or lock the structure.

To remove deviated key 4, deviated key 4 may be rotated back to a position in which offset arm 16 may be in line with pin slots 34. A user may move protuberance 24 and deviated key 4 away from notch housing 50. The angled cut of pin engagements 20 may force tumbler pins 26 upon on base plane 22, as illustrated in FIG. 4. Current technology may not incorporate a base plane 22. The lack of a base plane 22 may prevent deviated key 4 from being removed from high security locking system 2 as tumbler pins 26 may not be able to be disposed once again on idler block 10. Ramps, cut into idler block 10, may be necessary to lift tumbler pins 26 off base plane 22 on which tumbler pins 26 are disposed and back to the outer diameter surface of block idler 10. Without ramps, tumbler pins 26 may lock idler block 10 in place. Disposing tumbler pins 26 on idler block 10 may allow deviated key 4 to rotate, disposing offset arm 16 at the lower part of lock housing 6, best illustrated in FIG. 3. This may allow deviated key 4 to be removed from lock housing 6 and high security locking system 2.

Figure 6:
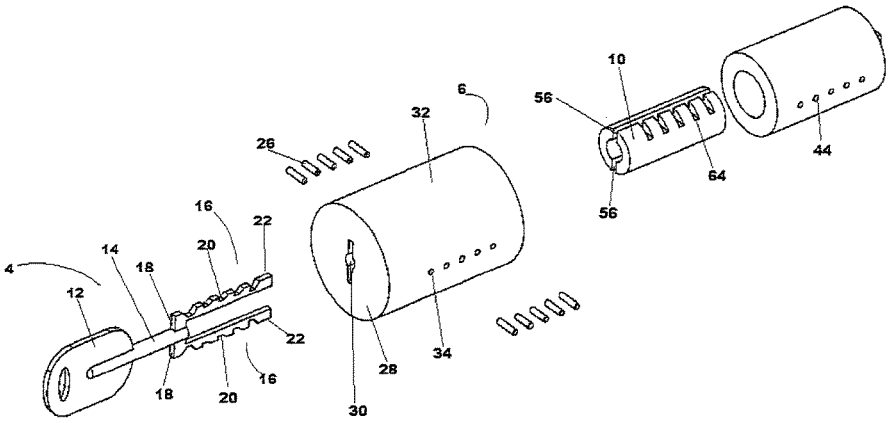
FIG. 6 illustrates an alternative embodiment of the high security locking system.

FIG. 6 illustrates an alternative embodiment of high security locking system 2. As illustrated, high security locking system 2 may comprise deviated key 4, lock housing 6, lock cylinder 8, and idler block 10. As described above, deviated key 4 may comprise a handle 12, shaft 14, and a plurality of offset arms 16. Specifically, deviated key 4 may be described as a forward fork assembly. Deviated key 4 may comprise two diametrically opposed and axially extending offset arms 16 which may have pin engagements 20 and base plane 22. In embodiments, there may be a plurality of offset arms 16 that may attach to shaft 14 through extensions 18. Extensions 18 may support the respective pair of diametrically opposed offset arms 16, where extensions 18 may extend radially between shaft 14 and offset arms 16 respectively. This may allow offset arms 16 to be spaced radially outward from the deviated key 4 axis. In embodiments, offset arms 16 may protrude axially forward from shaft 14. Additionally, in embodiments not illustrated, offset arms 16 may protrude axially backward from shaft 14 or remain even with shaft 14. This may vary the configuration within lock housing 6, making it harder to tamper with.

Lock housing 6, as illustrated in FIG. 6, may comprise tumbler pins 26, faceplate 28, keyhole 30, outside wall 32, pin slots 34, and groove 38. As described above, lock housing 6 may be disposed within a structure and act as a platform in which lock cylinder 8 and idler block 10 may be disposed. Lock housing 6 may be a tubular structure with an outside wall 32. Outside wall 32 may conceal and protect tumbler pins 26 and pin slots 34. Tumbler pins 26 may be disposed upon lock idler block 10. Additionally, not illustrated, springs may be disposed within pin slots 34, which may exert force upon tumbler pins 26. Keyhole 30, as described above, may be disposed at the front of lock housing 6. In embodiments, keyhole 30 may take any shape that may allow for the insertion of deviated key 4 into lock housing 6 and lock cylinder 8. In embodiments, lock cylinder 8 may be inserted into lock housing 6 and held in place by a snap ring 60, best illustrated in FIG. 7. Snap ring 60 may be seated inside groove 38, preventing axial movement of lock cylinder 8 and allowing for rotational movement of lock cylinder 8.

Figure 7:
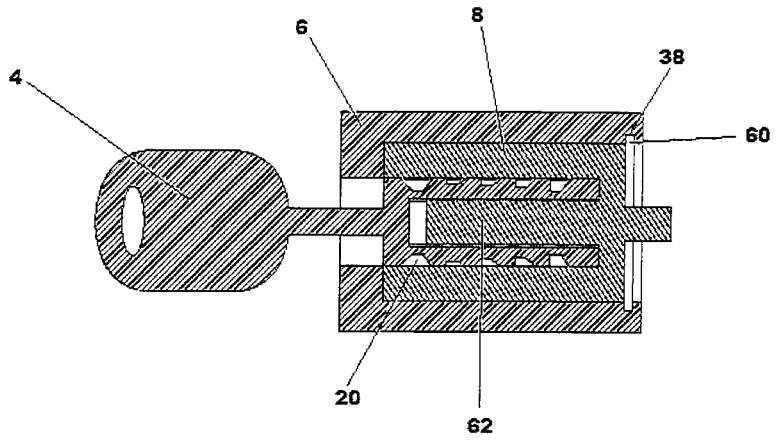
FIG. 7 illustrates a deviated key inserted into the high security locking system of FIG. 6.

As illustrated in FIGS. 6 and 7, lock cylinder 8 may comprise second pin slots 44, tubular wall 46, back wall 48, bolt assembly 52, and block 62. As described above, tubular wall 46 may conceal and protect idler block 10 and second pin slots 44. Bolt assembly 52 may attach to the back wall 48 of lock cylinder 8, which may allow for an operator to move a bolt, not illustrated, into a locked an unlocked position. Best illustrated in FIG. 7, block 62 may attach to back wall 48. In embodiments, block 62 may be solid or hollow and may be disposed about the center of back wall 48. Block 62 may function to prevent tampering tools from accessing tumbler pins 26. Block 62 may protrude axially about the length of lock cylinder 8, which may provide a ledge in which idler block 10 may be disposed. As best seen on FIG. 7, block 62 may be disposed within tubular wall 46.

Idler block 10, as illustrated in FIG. 6, may comprise a plurality of channels 56 and pin grooves 64. In embodiments, idler block 10 may be disposed within lock cylinder 8. Block 62 of lock cylinder 8 may extend into idler block 10 while idler block 10 is disposed within tubular wall 46 of lock cylinder 8. Idler block 10 may prevent tampering tools from accessing tumbler pins 26. In embodiments, offset arms 16 of deviated key 4 may be inserted through keyhole 30 and into channels 56, coming to rest against back wall 48 of lock cylinder 8. Channels 56 may run the length of idler block 10, which may allow for deviated key 4 to be fully inserted into high security locking system 2. In embodiments, at least one pin groove 64 may be disposed on the outer edge of idler block 10. As described below, pin grooves 64 may help in disposing tumbler pins 26 on idler block 10, which may allow for the removal of deviated key 4 from high security locking system 2.

Figure 8:
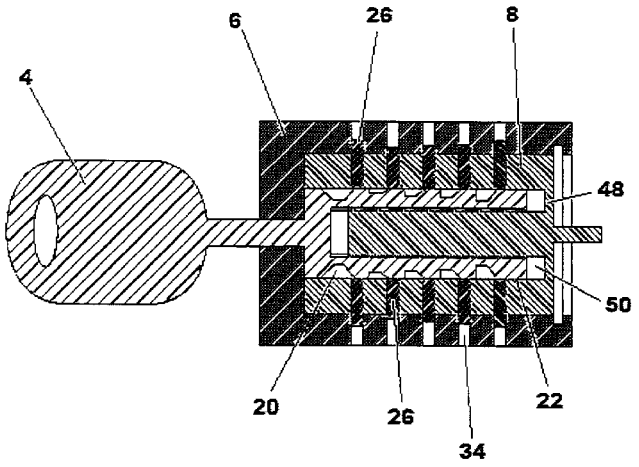
FIG. 8 illustrates the deviated key rotated in the high security locking system of FIG. 6.
Figure 9:
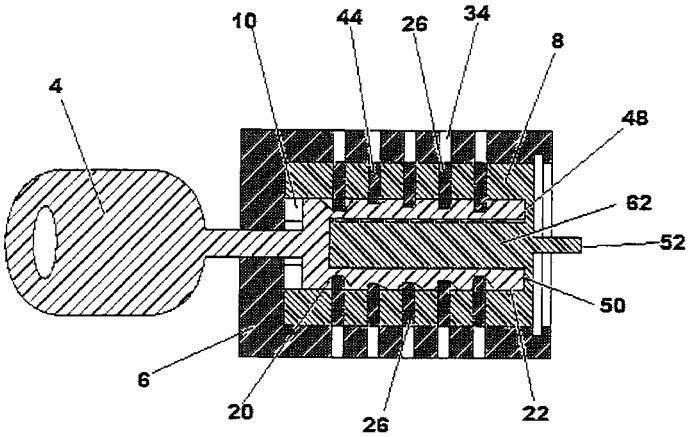
FIG. 9 illustrates the deviated key engaging a set of tumbler pins in the high security locking system of FIG. 6.

Embodiments for operations of high security locking system 2 of FIG. 6 will now be described with reference to FIG. 6-9. As illustrated in FIG. 7, deviated key 4 may be inserted into lock housing 6 through keyhole 30. Offset arms 16 traverse through channels 56 of idler block 10 and may come to rest at back wall 48 of lock cylinder 8. An operator may then rotate deviated key 4 in any direction, which may place force upon idler block 10 through offset arms 16. The force exerted upon channels 56 may rotate idler block 10. Referring not to FIG. 8, deviated key 4 is shown after it has been rotated, for example, ninety degrees. Offset arms 16 may align with tumbler pins 26, pin slots 34, and second pin slots 44. Tumbler pins 26 may move from resting on idle block 10 to offset arms 16. As discussed above, tumbler pins 26 may rest on base plane 22 of offset arms 16. Tumbler pins 26 may be disposed between pin slots 24 and second pin slots 44, which may prevent lock cylinder 8 from rotation. Rotating deviated key 4 may further expose notch housings 50 in back wall 48, as illustrated in FIG. 8. This may allow an operator to slide deviated key 4 forward into notch housings 50, as illustrated in FIG. 9. Sliding deviated key 4 forward may cause tumbler pins 26 to drop into pin engagements 20 of offset arms 16. This may move remove tumbler pins 26 from pin slots 34, which may allow lock cylinder 8 to rotate, unlocking or locking a structure by moving a bolt with bolt assembly 52. As discussed above, lock cylinder 8 may rotate from the force exerted upon notch housings 50 from deviated key 4. Deviated key 4 may be held in place by tumbler pins 26 during rotation of lock cylinder 8.

Figure 10:
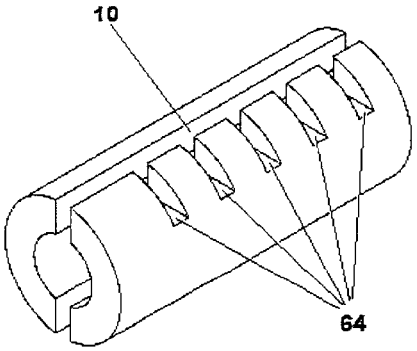
FIG. 10 illustrates an embodiment of an idler block.

To remove deviated key 4 from high security locking system 2, lock cylinder 8 may be rotated to align tumbler pins 26 with second pin slots 44. An operator may remove deviated key 4 from notch housing 50 by moving deviated key 4 toward face plate 28. The angle of pin engagements 20 may allow tumbler pins 26 to slide up pin engagements 20 onto base plane 22. Tumbler pins 26 may bridge pin slots 34 and second pin slots 44, preventing lock cylinder 8 from rotating. Deviated key 4 may rotate to align with keyhole 30 without rotating cylinder 8. As deviated key 4 rotates, tumbler pins 26 may be disposed on pin grooves 64, traversing pin grooves 64 as idler block 10 is rotated. As illustrated in FIG. 10, idler block 10 may comprise pin grooves 64. In embodiments, if high security locking system 2 were tampered with and block idler 10 may be rotated, tumbler pins 26 may fall into pin groves 64 without pin engagements 20. This may prevent idler block 10 from rotating further without deviated key 4. Additionally, pin grooves 64 may dispose tumbler pins 26 on the outside of idler block 10, which may allow for the free rotation of idler block 10 and realignment with keyhole 30. Aligned with keyhole 30, deviated key 4 may be removed from high security locking system 2.

Figure 11:
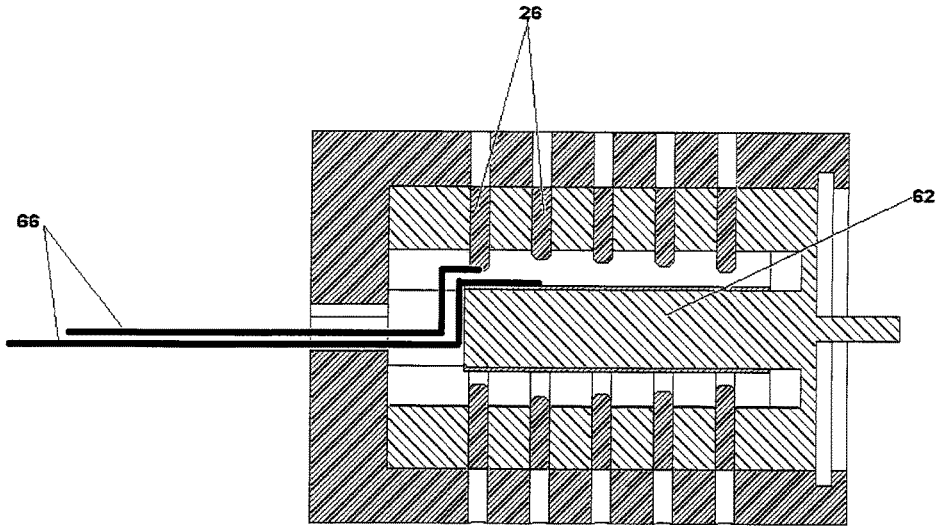
FIG. 11 illustrates a set of tampering tools within the high security locking system of FIG. 6.

Attempting to tamper with tumbler pins 26 of high security locking system 2, illustrated in FIG. 11, may be extremely difficult in accordance with example embodiments. Tampering tools 66, represented by dark lines, illustrates the challenges one may face in order to move tumbler pins 26 without a proper deviated key 4. In the illustrated embodiment, idler block 10 (not visible) has already been rotated using a tool so that channel 56 is in position with tumbler pins 26. However, as illustrated, the tampering tools may not be able to reach more than one or two of tumbler pins 26. In the embodiment of FIG. 11, block 62 may prevent direct access to each and every pin 26, and tampering tools 66 may not be able to reach each pin 26 because tumbler pins 26 are disposed in a row. This may prevent the necessary number of tampering tools 66 from reaching each and every pin 26. Additional variations of high security locking system 2 may further help in preventing tampering with tumbler pins 26.

Figure 12:
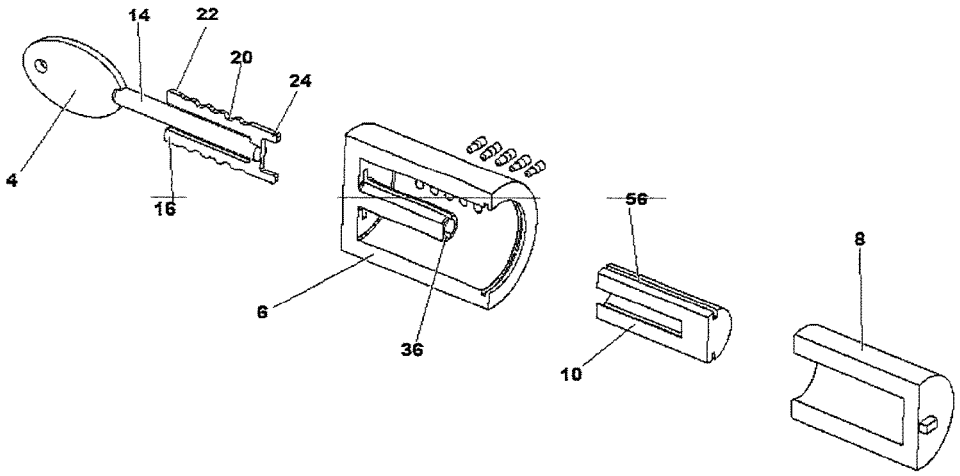
FIG. 12 illustrates an alternative embodiment of the high security locking system.

Referring now to FIG. 12, an alternative embodiment of high security locking system 2 is illustrated. As illustrated, high security locking system 2 may comprise a deviated key 4, lock housing 6, lock cylinder 8, idler block 10, and covered deviated key way 36. In the illustrated embodiment, the deviated key 4 is in the form of a reverse fork. For example, the deviated key 4 deviated key 4 may comprise at least two offset arms 16 which may extend backward axially from shaft 14. Each offset arm 16 may attach to shaft 14 through extension 18. Additionally, each offset arm 16 may comprise pin engagements 20, base plane 22, and protuberance 24. Deviated key 4 may be inserted into high security locking system 2 to unlock or lock high security locking system 2.

Figure 13:
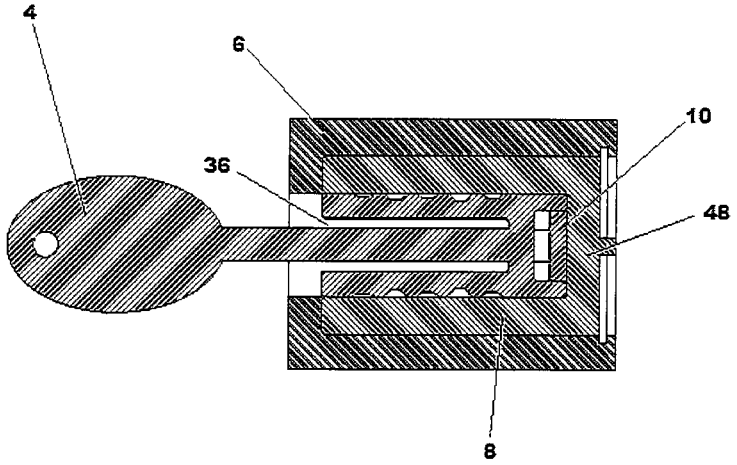
FIG. 13 illustrates a deviated key inserted into the high security locking system of FIG. 12.
Figure 14:
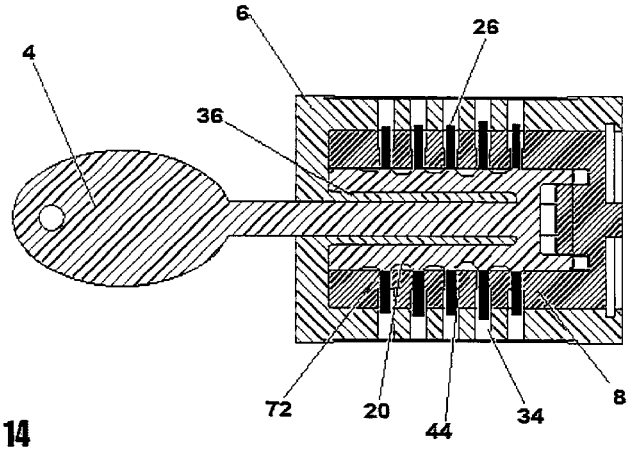
FIG. 14 illustrates the deviated key rotated in the high security locking system of FIG. 12.
Figure 15:
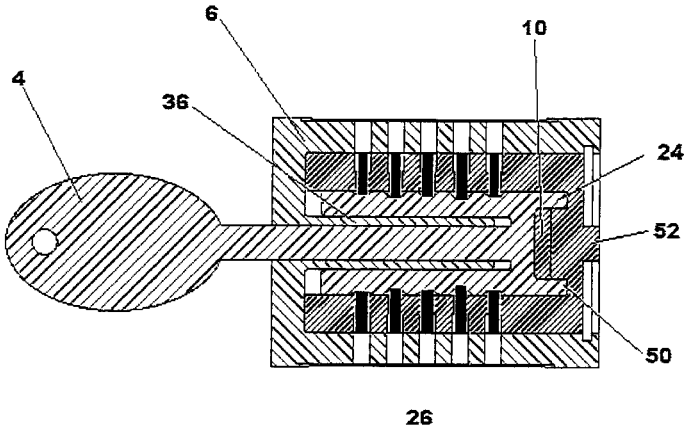
FIG. 15 illustrates the deviated key engaging a set of tumbler pins in the high security locking system of FIG. 12.

With reference now to FIGS. 13-15, use of deviated key 4 to lock and unlock high security locking system 2 will now be described in accordance with example embodiments. As illustrated in FIG. 13, deviated key 4 may be inserted into high security locking system 2 and offset arms 16 of deviated key 4 may move axially through channels 56 of idler block 10. Deviated key 4 may come into contact with back wall 46 of lock cylinder 8, which may prevent further axial movement. Deviated key 4 may rotate, disposing force upon idler block 10 through offset arms 16. FIG. 14 illustrates deviated key 4 after it has been rotated, for example, ninety degrees. As illustrated, deviated key 4, wherein offset arms 16 have been aligned with tumbler pins 26, pin slots 34, and second pin slots 44. Rotation of deviated key 4 may dispose tumbler pins 26 on base plane 22. Tumbler pins 26 may bridge pin slots 34 and second pin slots 44. Additionally, rotation of deviated key 4 may uncover notch housings 50. An operator may slide deviated key 4 axially into notch housing 50. As illustrated in FIG. 15, protuberance 24 of each offset arm 16 may be disposed within notch housings 50. Sliding deviated key 4 axially into notch housings 50 may allow tumbler pins 26 to be disposed within pin engagements 20. Disposed in pin engagements 20, tumbler pins 26 may not bridge pin slots 34 and second pin slots 44. This may allow for lock cylinder 8 to rotate. An operator may rotate deviated key 4, which may exert force through notches 24 upon notch housings 50. This may rotate lock cylinder 8 and in turn rotate bolt assembly 52. Rotation of bolt assembly 52 may maneuver a bolt, not illustrated, within a structure, unlocking or locking the structure and allowing for deviated key 4 to be removed.

Deviated key 4 may be removed by rotating deviated key 4 to align offset arms 16, tumbler pins 26, pin slots 34, and second pin slots 44. This may allow an operator to axially move deviated key 4 from notch housing 50 and toward face plate 28. As discussed above, as deviated key 4 is moved axially toward face plate 28, pin engagements may help dispose tumbler pins 26 upon base plane 22, as illustrated in FIG. 14. Tumbler pins 26 may now bridge pin slots 34 and second pin slots 44, which may prevent lock cylinder 8 from rotating. Deviated key 4 may rotate to align with keyhole 30, as illustrated in FIG. 13. As deviated key 4 rotates, pin grooves 64 on idler block 10 may help in disposing tumbler pins 26 on the outside of idler block 10, which may allow deviated key 4 to rotate effortlessly. Deviated key 4 may rotate idler block 10 through offset arms 16 exerting pressure upon channels 56. This may align offset arms 16 and channels 56 with keyhole 30, which may allow an operator to remove deviated key 4 from high security locking system 2.

Figure 16:
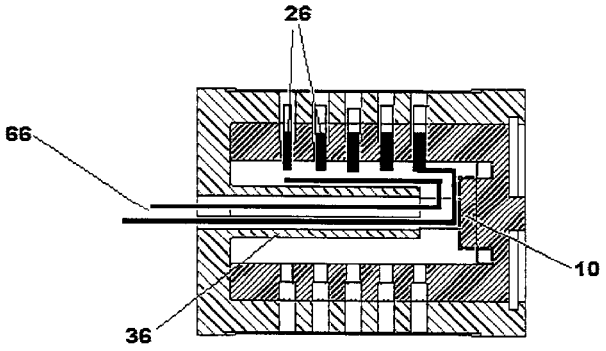
FIG. 16 illustrates a set of tampering tools within the high security locking system of FIG. 12.

As illustrated in FIG. 16, an offset deviated key 4 in the form of a reverse fork may provide additional protection from tampering tools 66. In the illustrated embodiment, a tool (not shown) has already been used to move idler block 10. Tampering tools 66, illustrated as black lines, may need to be inserted into lock housing 6, move idler block 10, not illustrated, and reach backwards to access tumbler pins 26. This may make it extremely difficult to insert a plurality of tampering tools 66 in two directions opposite each other and contact each pin 26. This embodiment may prevent high security locking system 2 from being effectively tampered with. Additional embodiments of high security locking system 2 may also be utilized to prevent tampering.

Figure 17:
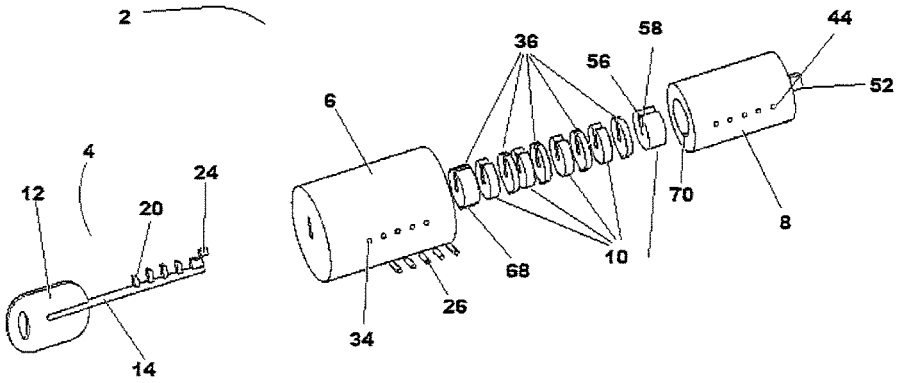
FIG. 17 illustrates an alternative embodiment of the high security locking system.
Figure 18:
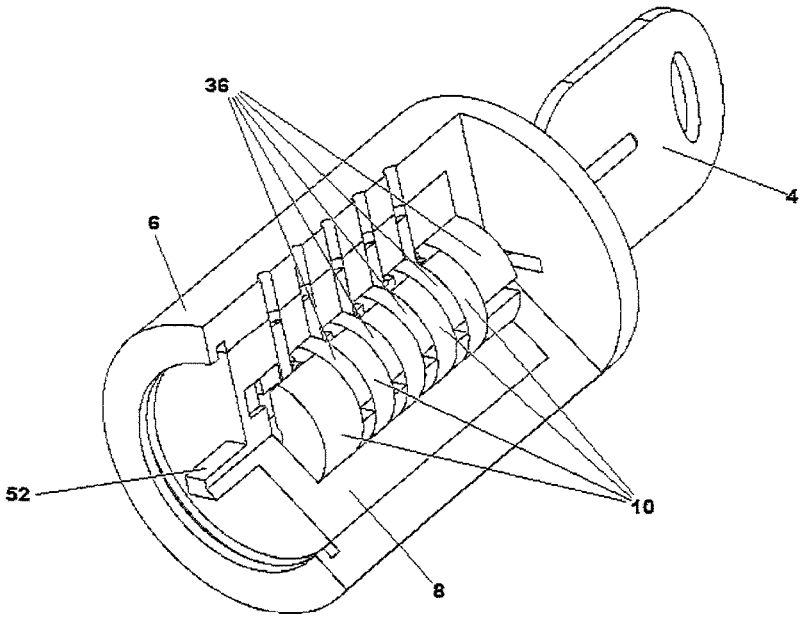
FIG. 18 illustrates an isometric view of a deviated key inserted into the high security locking system of FIG. 17.

Referring now to FIGS. 17 and 18, an alternative embodiment of high security locking system is illustrated. In embodiments, high security locking system 2 may comprise a deviated key 4, lock housing 6, lock cylinder 8, tumbler pins 26, and a plurality of idler blocks 10. In the illustrated embodiment, deviated key 4 is in the form of a transverse fork, which may provide another type of tampering protection for high security locking system 2. Deviated key 4, as illustrated in FIG. 17 may comprise a handle 12, shaft 14, pin engagements 20, and protuberance 24. In embodiments there may be at least one pin engagement 20. Pin engagements 20 may extend away from shaft 14 on a perpendicular plane to shaft 14. In embodiments, pin engagements 20 may be square, rectangular, cylindrical, and/or any combination thereof. Additionally the end of pin engagements 20 opposite shaft 14 may be angled, notched, planar, and/or any combination thereof. Pin engagements 20 may be spaced at any suitable distance from each pin engagement 20. Specifically, pin engagements 20 may be spaced about one millimeter to about ten millimeters, about three millimeters to about six millimeters, about ten millimeters to about one hundred millimeters, about twenty millimeters to about eighty millimeters, about fourth millimeters to about sixty millimeters, about fifty millimeters to about seventy-five millimeters, or about twenty-five millimeters to about fifty millimeters. In embodiments, pin engagements 20 may interact with individual idler blocks 10.

In embodiments, there may be a plurality of idler blocks 10, best illustrated in FIG. 17. Idler blocks 10 may be disk-shaped and may rotate when pressure may be applied by pin engagements 20. Additionally, idler blocks 10 may each comprise channel 56 and deviated key cutout 58. Channel 56 and deviated key cutout 58 may traverse the length of each idler block 10. In embodiments, channel 56 and deviated key cutout 58 may allow pin engagements 20 and shaft 14 of deviated key 4 to traverse the length of idler blocks 10, respectively. In embodiments, protrusions 68 may extend from idler blocks 10 at any suitable location along the edge of idler block 10. Specifically, protrusions 68 may extend from the edge opposite channel 56. In embodiments protrusions 68 may slide into protrusion groove 70, which may be disposed in lock cylinder 8. Protrusion 68 disposed within protrusion groove 70 may prevent stationary block 36 rotating. In embodiments, stationary block 36 may be disk shaped. Stationary blocks 36 may prevent deviated key 4 from rotating in the event a pin engagement 20 applies force to stationary block 36. This may add a layer of additional layer of protection to high security locking system 2 by requiring pin engagements 20 to align with idler blocks 10 that may be rotatable. FIG. 18 best illustrates stationary block 36 and idler blocks 10 in operation. In embodiments, idler blocks 10 may allow pin engagements 20 to access tumbler pins 26.

Figure 19:
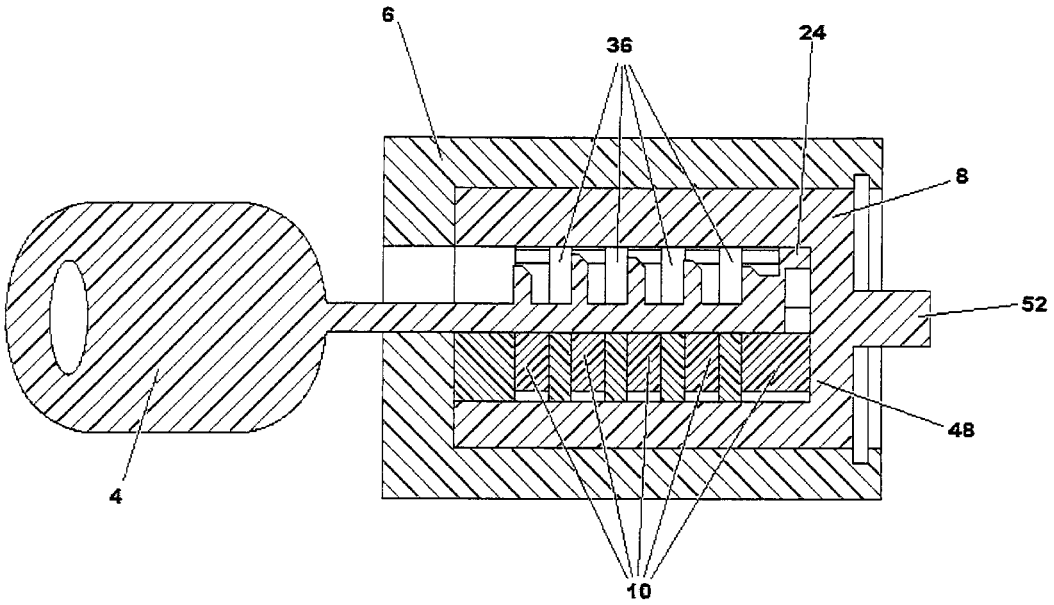
FIG. 19 illustrates the deviated key inserted into the high security locking system of FIG. 17.
Figure 20:
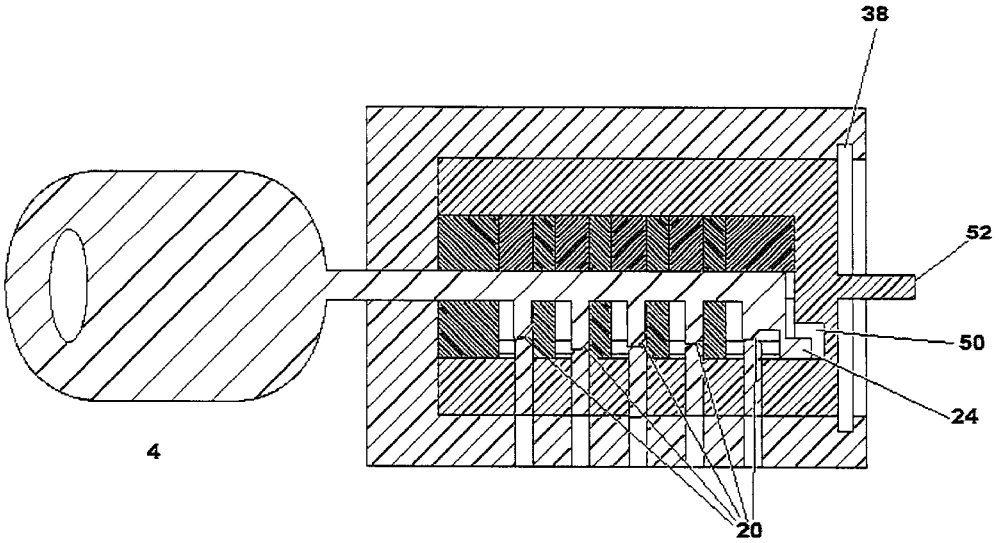
FIG. 20 illustrates the deviated key rotated in the high security locking system of FIG. 17.

Referring now to FIGS. 18-20, a procedure to unlock and/or lock high security locking system 2 will now be described in accordance with example embodiments. FIG. 19 illustrates the insertion of deviated key 4 within lock housing 6, lock cylinder 8, idler blocks 10, and stationary block 36. Pin engagements 20 may align with idler blocks 10 as protuberance 24 may come into contact with back wall 48 of lock cylinder 8. FIG. 18 illustrates the rotation of deviated key 4. As illustrated, idler blocks 10 may rotate as pressure is applied to them through pin engagements 20. Stationary block 36 may be stationary, which may prevent the removal of deviated key 4. Tumbler pins 26 may move from the outside of idler blocks 10 to pin engagements 20. As pin 26 are disposed upon base plane 22 of pin engagements 20, tumbler pins 26 may bridge pin slots 34 and second pin slots 44, which may prevent lock cylinder 8 from rotating. As described above, lock cylinder 8 may be prevented from moving axially along lock housing 6, due to a snap ring, not illustrated, disposed in groove 38. Additionally, the rotation of idler blocks 10 may expose notch housing 50, which may allow a user to move deviated key 4, and thus protuberance 24, into notch housing 50. FIG. 20 illustrates protuberance 24 within notch housing 50, which may occur as an operator axially moves deviated key 4 along lock housing 6. Insertion of protuberance 24 within notch housing 50 may cause tumbler pins 26 to be disposed along the angled cuts of pin engagements 20, which may allow tumbler pins 26 to fall within second pin slots 44 and not bridge pin slots 34. This may allow lock cylinder 8 to rotate, which may rotate bolt assembly 52. Rotation of bolt assembly 52 may move a bolt, not illustrated, which may lock or unlock a structure. Rotation of lock cylinder 8 may occur when force is placed upon notch housing 50 through protuberance 24.

Removal of deviated key 4 from high security locking system 2 may be accomplished by rotating lock cylinder 8, second in plots 44, and pin slots 34 in line with each other. Deviated key 4 may then move axially toward face plate 28, pin engagements 20 may force tumbler pins 26 to bridge pin slots 34 and second pin slots 44 as tumbler pins 26 may be position on base plane 22. This may prevent lock cylinder 8 from rotating. Deviated key 4 may then rotate to align with keyhole 30 for removal. Rotation of deviated key 4, as described above, may dispose tumbler pins 26 upon idler blocks 10. Grooves along idler block 10 may assist in moving tumbler pins 26 to the outer edge of idler block 10. Aligned with keyhole 30, deviated key 4 may be removed from lock housing 6.

Figure 21:
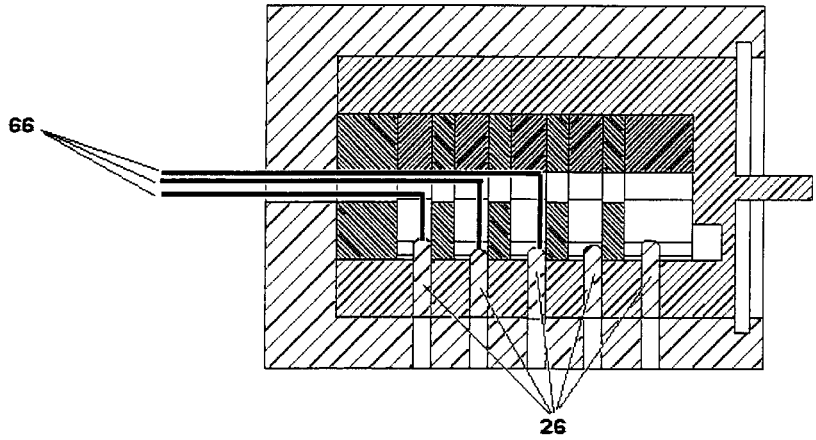
FIG. 21 illustrates the deviated key engaging a set of tumbler pins in the high security locking system of FIG. 17.

As illustrated in FIG. 21, tampering tools 66, illustrated by black lines, may be prevent from accessing each and every pin 26. In the illustrated embodiment, a tool (not shown) has already been used to move idler blocks 10. Deviated key cutout 58 may prevent the necessary amount of tampering tools 66 from reaching each and every pin 26. This may prevent tampering tools 66 from unlocking and/or locking high security locking system 2.

Figure 22:
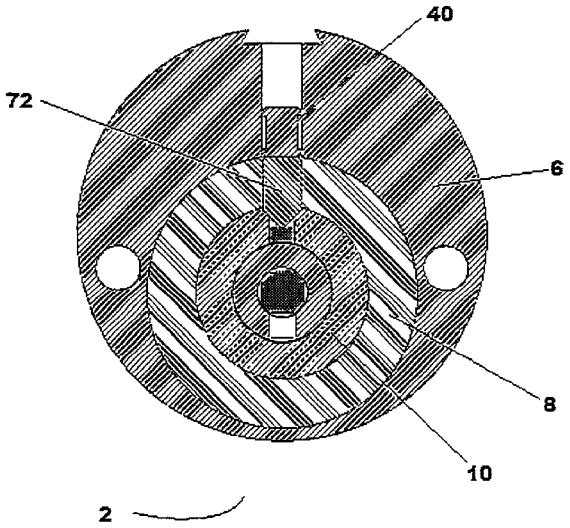
FIG. 22 illustrates a high security locking system with a long pin.
Figure 23:
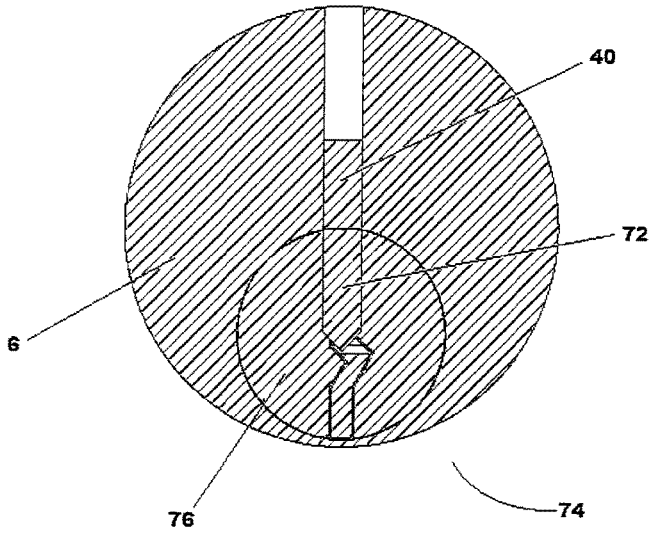
FIG. 23 illustrates a standard lock with a long pin.

FIG. 22 illustrates an alternative embodiment if a high security locking system 2. In the illustrated embodiment, a long pin 72 may be disposed within lock housing 6 and lock cylinder 8 among tumbler pins 26. Long pin 72 may traverse the length of lock cylinder 8. This may dispose an upper pin 40 within lock housing 6, allowing lock cylinder 8 to rotate in relation to lock housing 6, as the shear plain between lock cylinder 8 and lock housing 6 is unobstructed. As illustrated, the long pin 72 in its lowest position allows rotation of the lock cylinder 8 with respect to the lock housing 6. Accordingly, embodiments may require long pin 72 to be in its lowest position to allow opening of high security locking system 2. Any upward movement of long pin 72 will cause the long pin 72 to block the shear plain between the lock cylinder 8 and the lock housing 6, preventing relative rotation. Long pin 72 may form a layer of protection, preventing tampering with high security locking system 2. For example, long pin 72 may function to make high security locking system 2 bump proof, as any upward movement of long pin 72 will block the shear plain. By of further example, if long pin 72 is tampered with it may be pushed upward by a tool, not illustrated. Due to the length of long pin 72, any movement upward may partially disposed long pin 72 within lock housing 6. Partially disposed within lock housing 6 and lock cylinder 8, long pin 72 may prevent lock cylinder 8 from rotating in relation to lock hosing 6. Additionally, in order for tampering tools to reach tumbler pins 26 disposed behind long pin 72 the tampering tools may raise long pin 72 to access additional tumbler pins 26. This may partially dispose long pin 72 within lock housing 6, preventing movement of lock cylinder 8. In embodiments, long pin 72 may also be disposed within a standard lock 74, as illustrated in FIG. 23. Standard lock 74 may comprise a lock housing 6 and rotation housing 76. Rotation housing 76 may also be commonly referred to as a "plug." In embodiments, long pin 72 may function as a layer of protection within standard lock 74 as with high security locking system 2. As illustrated, long pin 72 may traverse the length of rotation housing 76. This may dispose upper pin 40 within lock housing 6, allowing lock cylinder 8 to rotate in relation to lock housing 6, as described above. As illustrated, the long pin 72 in its lowest position allows rotation of the rotation housing 76 with respect to the lock housing 6. Accordingly, embodiments may require long pin 72 to be in its lowest position to allow opening of standard lock 74. Any upward movement of long pin 72 will cause the long pin to block the shear plain between the lock cylinder 8 and the lock housing 6, preventing relative rotation.

Figure 24:
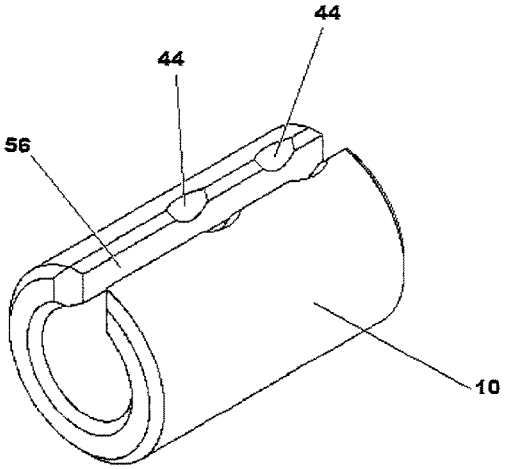
FIG. 24 illustrates a idler block comprising depressions to vary depth of second pin holes.
Figure 25:
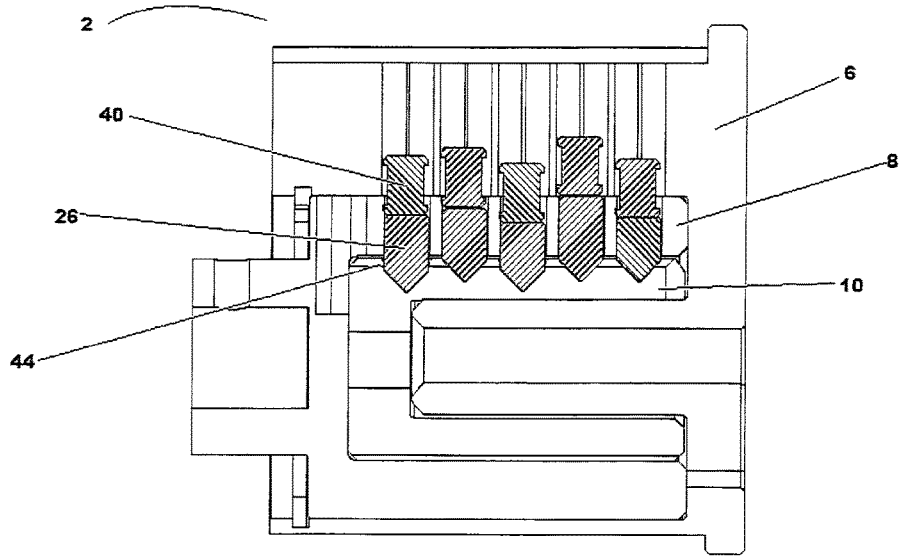
FIG. 25 illustrates a side view of a high security locking system with second pin holes at varying depths within the idler block.

In some embodiments, additional security features that may be instituted within high security locking system 2 may be second pin holes 44, disposed within idler block 10. In embodiments, second pin holes 44 may traverse both lock cylinder 8 and idler block 10. Second pin holes 44 disposed within idler block 10 may be at different depths. As illustrated in FIGS. 24-25, second pin holes 44 may be disposed along channel 56 and may align with tumbler pins 26. In embodiments there may be any number of second pin holes 44 and/or none at all. As illustrated in FIG. 25, by varying the depths of second pin holes 44, tumbler pins 26 may be at different heights from one another when at the bottom of their respective second pin holes 44. The depths of second pin holes 44 may be any suitable length, which may allow a tumbler pin 26 to traverse any suitable depth within idler block 10. Second pin holes 44 may have the same depth and/or a random assortment of depths. Varying the depth of second pin holes 44 may form a layer of protection, preventing tampering with high security locking system 2, in some embodiments. By way of example, a bump key that may inserted into high security locking system 2 to interact with tumbler pins 26 at their lowest point may not engage one or more of the tumbler pins 26 as they may be disposed at different heights.

Figure 26:
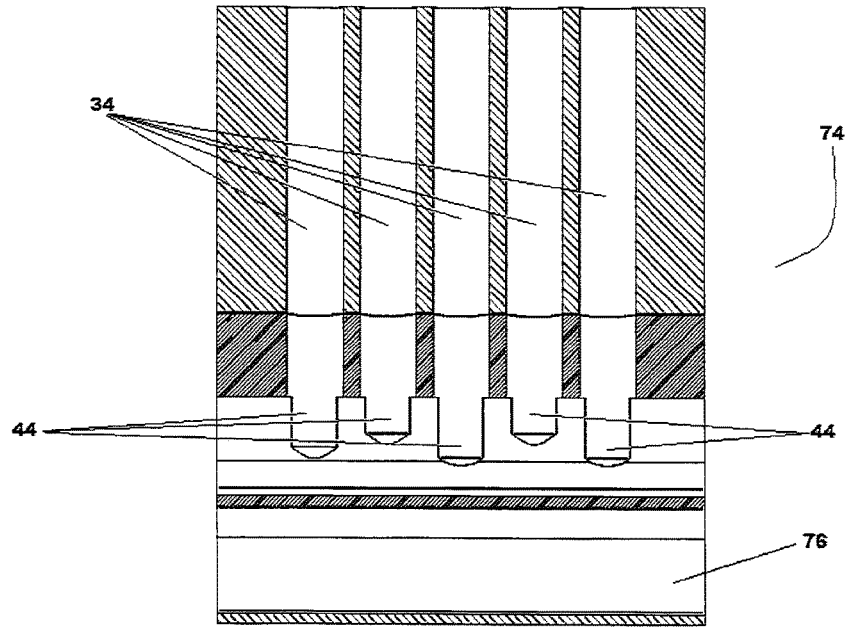
FIG. 26 illustrates a side view of a standard lock comprising second pin holes of varying depth.
Figure 27:
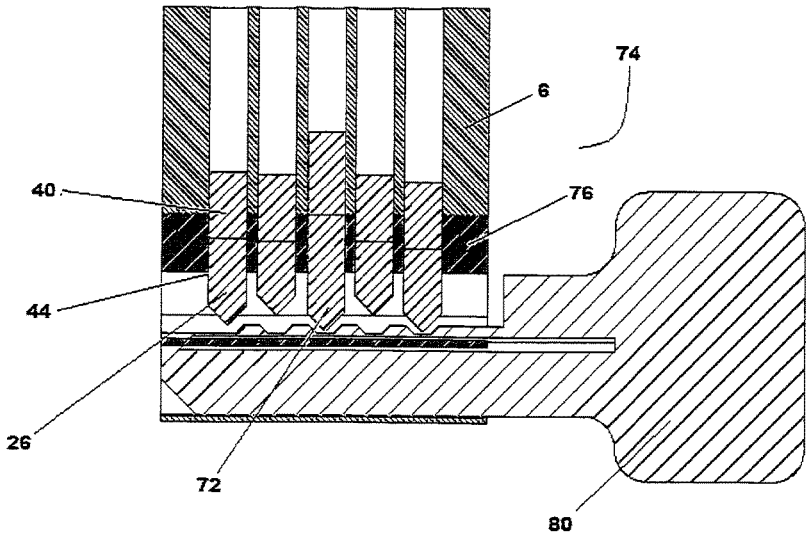
FIG. 27 illustrates a side view of a standard lock with a rotation housing comprising second pin holes in which tumbler pins and a long pin are disposed.
Figure 28:
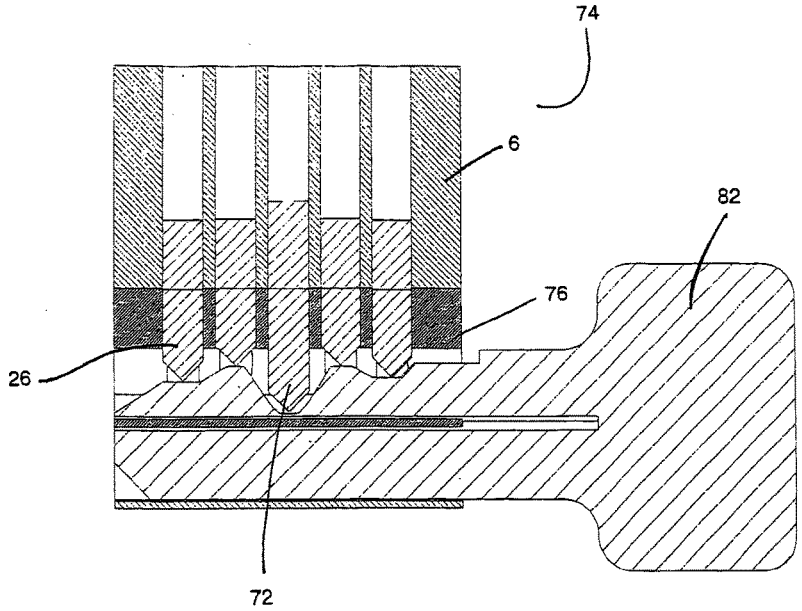
FIG. 28 illustrates a standard key properly aligning tumbler pins within the rotation housing.

Referring now to FIG. 26, embodiments may include use of second pin holes 44 at different depths in a standard lock 74. As illustrated in FIG. 26, a standard lock 74 may comprise a lock housing 6 and a rotation housing 76. First pin holes 34 may be formed in lock housing 6 and second pin holes 44 may be formed in rotation housing 76. FIG. 27 illustrates standard lock 74 with tumbler pins 26 and upper pins 40 installed. As illustrated, varying depth of second pin holes 44 may dispose tumbler pins 26 at different heights in rotation housing 76. As illustrated, one of tumbler pins 26 may be in the form of a long pin 72. By way of example, long pin 72 may be positioned so that in its lowest position the shear plan between the rotation housing 76 and lock housing 6 may be unobstructed, allowing rotation of rotation housing 76. Accordingly, any upward movement of long pin 72 may cause long pin 72 to block the shear plain, thus preventing rotation. Tampering key 80, as further illustrated in FIG. 27, may not be able to properly gauge the extent to which tumbler pins 26 may need to be raised and/or lowered, allowing for rotation housing 76 to rotate within lock housing 6. By varying depths of second pin holes 44, the tumbler pins 26 may be at different heights so that tampering key 80 may not engage one or more of tumbler pins 26 when inserted into standard lock 74. Moreover, any effort to move tampering key 80 to engage pins 26 may cause tampering key 80 to engage long pin 72 causing it to move into lock housing 6, which may further prevent movement of rotation housing 76. As illustrated in FIG. 28, a standard key 82 may be used to properly align tumbler pins 26 and long pin 72 within lock housing 6 and rotation housing 76. This may allow rotation housing 76 to rotate in relation to lock housing 6. In embodiments, standard key 82 may engage tumbler pins 26 causing them to move into a position allowing rotation of rotation housing 76. It should further be noted that there may be a plurality of long pins 72 within standard key 82 and high security locking system 2. In some embodiments, varying depth of second pin slots 44 and long pins 72 may be successfully used prevent tampering key 80 from operating standard lock 74

The foregoing figures and discussion are not intended to include all features of the present techniques to accommodate a buyer or seller, or to describe the system, nor is such figures and discussion limiting but exemplary and in the spirit of the present techniques.

What is claimed is:

1. A high security locking system comprising:

a deviated key;

a lock housing, wherein the lock housing comprises a face plate with a keyhole for receiving the deviated key, wherein the lock housing includes first pin slots formed in the lock housing;

a lock cylinder disposed within the lock housing so as to be selectively rotatable relative to the lock housing, wherein the lock cylinder includes second pin slots formed in the lock cylinder;

tumbler pins at least partially received within the second pin slots and being movable between a first position in which the lock cylinder is fixed relative to the lock housing and a second position in which a shear plane between the lock housing and the lock cylinder is not blocked to enable rotation of the lock housing relative to the lock cylinder;

an idler block disposed within the lock cylinder, wherein the idler block includes a channel receiving the deviated key therein such that the idler block is rotatable with the deviated key relative to the lock cylinder to align the deviated key with one or more of the second pin slots in the lock cylinder; and a stationary block disposed within the lock cylinder in fixed relation to one of the lock cylinder or the lock housing, wherein the deviated key must rotate with the idler block relative to the stationary block without interference with the stationary block.

2. The high security locking system of claim 1, wherein the tumbler pins further comprises a long pin disposed at least partially in the second pin slots, wherein the long pin at its lowest position does not block a shear plane between the idler block and the lock cylinder.

3. The high security locking system of claim 1, wherein the deviated key is an axial fork key.

4. The high security locking system of claim 1, wherein the deviated key is a reverse axial fork key.

5. The high security locking system of claim 1, wherein the deviated key is a radial fork key.

6. The high security locking system of claim 1, wherein the deviated key comprises a shaft that defines a deviated key axis of rotation, and an offset arm that is radially offset from the deviated key axis of rotation, wherein the offset arm comprises a base plane and at least one pin engagement.

7. The high security locking system of claim 6, wherein the base plane is a single level across the offset arm.

8. The high security locking system of claim 6, wherein the offset arm comprises a protuberance at the end of the offset arm.

9. The high security locking system of claim 8, wherein the lock cylinder comprises a notch housing for receiving the protuberance in the offset arm.

10. The high security locking system of claim 1, wherein at least one ramp is disposed on the outer surface of the idler block.

11. The high security locking system claim 1, wherein the channel traverses the length of the idler block in the axial direction.

12. The high security locking system of claim 1, wherein the idler block comprises a plurality of idler blocks at spaced positions in the lock cylinder for receiving the deviated key.

13. The high security locking system of claim 1, wherein the stationary block is fixed to a back wall of the lock cylinder.

14. The high security locking system of claim 1, wherein the stationary block is fixed to a front wall of the lock cylinder housing.

15. The high security locking system of claim 1, wherein the stationary block is disk shaped and is fixed to a wall of the lock cylinder.

16. The high security locking system of claim 1, wherein the keyhole is in fixed relation to the lock housing.

17. The high security locking system of claim 1, wherein the channel in the idler block is aligned with the second pin slots only when the channel is misaligned with the keyhole in the faceplate of the lock housing.

18. The high securing locking system of claim 1 wherein the stationary block includes a channel which traverses the stationary block in the axial direction to receive the key axially therethrough and wherein the channel in the idler block is misaligned with the channel in the stationary block when the channel in the idler block is aligned with the second pin slots.

19. A method of operating a high security locking system comprising:

inserting a deviated key into a lock housing, wherein an idler block is disposed in the lock housing and blocks access of the deviated key to tumbler pins of the high security locking system, wherein the tumbler pins are positioned to prevent relative rotation between a lock cylinder and the lock housing, wherein the lock cylinder is disposed in the lock housing;

rotating the deviated key within the lock housing, wherein rotating the deviated key rotates the idler block with respect to the lock cylinder;

aligning the deviated key with one or more first pin slots in the lock housing and one or more second pin slots in the lock cylinder, wherein the tumbler pins are disposed in the pin slots and/or the second pin slots; and moving the deviated key translationally into a notch housing in the lock cylinder, wherein the moving the deviated key causes at least one of the tumbler pins to move and enable relative rotation between the locking cylinder and the lock housing.

20. The method of claim 19, wherein the deviated key comprises an offset arm.

* * * * *